US007780007B2

(12) United States Patent
Baker

(10) Patent No.: US 7,780,007 B2
(45) Date of Patent: Aug. 24, 2010

(54) MULTI-LAYERED BLISTER CARD PACKAGE AND METHOD FOR MAKING THE SAME

(75) Inventor: Mark Phillip Baker, Fort Wayne, IN (US)

(73) Assignee: Graphic Packaging International, Inc., Marietta, GA (US)

( * ) Notice: Subject to any disclaimer, the term of this patent is extended or adjusted under 35 U.S.C. 154(b) by 736 days.

(21) Appl. No.: 11/557,575

(22) Filed: Nov. 8, 2006

(65) Prior Publication Data

US 2008/0105586 A1 May 8, 2008

(51) Int. Cl.
*B65D 83/04* (2006.01)
*B65D 85/42* (2006.01)
*B65D 73/00* (2006.01)

(52) U.S. Cl. ..... 206/531; 206/532; 206/462

(58) Field of Classification Search ..... 206/528, 206/531, 532, 534–534.2, 538, 828, 807, 206/461, 462
See application file for complete search history.

(56) References Cited

U.S. PATENT DOCUMENTS

| | | | | |
|---|---|---|---|---|
| 2,415,859 | A | 2/1947 | Ancker | |
| 3,387,699 | A | 6/1968 | Heller | |
| 3,743,084 | A | 7/1973 | Douglas | |
| 3,912,081 | A | 10/1975 | Haines at al. | |
| 4,125,190 | A | 11/1978 | Davie, Jr. et al. | |
| 4,506,789 | A | 3/1985 | Dlugosz | |
| 5,050,739 | A | 9/1991 | Hannan et al. | |
| 5,174,442 | A | 12/1992 | Kurnit | |
| 5,265,728 | A | 11/1993 | Allendorf et al. | |
| RE35,445 | E | 2/1997 | Pora | |
| 5,820,165 | A | 10/1998 | Verenski | |
| 5,871,145 | A | 2/1999 | Hermann et al. | |
| 5,954,202 | A | 9/1999 | Mellon | |
| 6,024,222 | A | 2/2000 | Friberg et al. | |
| D422,210 | S | 4/2000 | Sturkle et al. | |
| 6,138,830 | A | 10/2000 | Muggli | |
| 6,219,997 | B1 | 4/2001 | Friberg et al. | |
| 6,659,280 | B2 | 12/2003 | Paliotta et al. | |
| 6,702,108 | B2 | 3/2004 | Lo Duca | |
| 6,951,282 | B2 * | 10/2005 | Jones | 206/469 |
| 7,464,818 | B2 * | 12/2008 | Gherdan et al. | 206/531 |
| 7,497,331 | B2 * | 3/2009 | Pham | 206/531 |
| 2004/0108240 | A1 | 6/2004 | Ragot | |
| 2004/0188312 | A1 * | 9/2004 | Stepowany | 206/531 |

(Continued)

*Primary Examiner*—Mickey Yu
*Assistant Examiner*—Melissa L Lalli
(74) *Attorney, Agent, or Firm*—Womble Carlyle Sandridge & Rice, PLLC

(57) ABSTRACT

A multi-layered blister package and assembling method include a blister sheet having a blisters for containing a product therein and an opposing cover surface adjacent to blister openings. The package also includes a front sheet having apertures configured to receive the blisters and a back sheet coupled to at least a portion of the front sheet. The back sheet includes an inner back panel foldably connected to an outer back panel. The inner and outer back panels each include removable tabs each covering an access slot. The tabs and access slots of the inner and outer back panels are in alignment when the inner back panel is folded adjacent to the outer back panel. The cover surface of the blister sheet is positioned adjacent to the inner back panel such that each blister opening is in alignment with the tabs and access slots of the inner and outer back panels.

8 Claims, 4 Drawing Sheets

U.S. PATENT DOCUMENTS

2006/0138015 A1* 6/2006 Freeze ..... 206/528
2007/0056876 A1* 3/2007 Jones ..... 206/531
2007/0068844 A1* 3/2007 Weston ..... 206/538
2007/0241552 A1* 10/2007 Watson et al. ..... 283/81

* cited by examiner

MULTI-LAYERED BLISTER CARD PACKAGE AND METHOD FOR MAKING THE SAME

BACKGROUND OF THE INVENTION

This invention relates generally to a blister card package for packaging a product and more particularly, to a multi-layered blister card package and method of making the same.

At least some known packages used for packaging products such as, but not limited to, tablets, capsules, and other similar products include blister cards to facilitate retaining, dispensing, concealing, transporting, and/or securing the products contained therein. At least some known push-through type blister card packages appear to include child-resistant, senior friendly, and tamperproof features. Although the known blister card packages may appear to share all of the above features, there often exits at least some negative tradeoff between such features.

For example, at least some known blister card packages may require greater human dexterity and strength to dispense the products. As a result, such known blister card packages may be more tamperproof and/or may provide greater safety for children by inhibiting access to the products contained therein. Therefore, accidental ingesting of the products by children may be restricted. Further, the products contained in such know blister card packages may be more easily dispensable by adults. However, such products may also be difficult to access by a senior citizen because of a lack of strength required to dispense the product.

Alternatively, at least some known blister card packages may require less strength to dispense the products. As a result, such known blister card packages may provide greater simplicity for adults and seniors by allowing easier dispensing of the products contained therein. Further, the products provided in such known blister card packages may be more easily dispensed by seniors. However, such products may be less tamperproof and/or easily accessed by children that have the strength required to dispense the product. Therefore, such known blister card packages provide less safety for children.

BRIEF DESCRIPTION OF THE INVENTION

In one aspect, a multi-layered blister package is provided. The multi-layered blister package includes a blister sheet having a plurality of blisters for containing a product therein and an opposing cover surface. Each blister includes an opening adjacent to the cover surface. The multi-layered blister package also includes a front sheet having a plurality of apertures configured to receive the plurality of blisters on the blister sheet. Further, the multi-layered package includes a back sheet coupled to at least a portion of the front sheet. The back sheet includes an inner back panel foldably connected to an outer back panel. The inner and outer back panels each include a plurality of removable tabs each covering an access slot. The tabs and access slots of the inner back panel are in alignment with the tabs and access slots of the outer back panel when the inner back panel is folded adjacent to the outer back panel. The cover surface of the blister sheet is positioned adjacent to the inner back panel such that each blister opening is in alignment with the tabs and access slots of the inner back panel and the tabs and access slots of the outer back panel.

In another aspect, a back sheet is provided. The back sheet includes an outer back panel and an inner back panel foldably connected to the outer back panel. The inner and outer back panels each include a plurality of removable tabs each covering an access slot. The tabs and access slots of the inner back panel are in alignment with the tabs and access slots of the outer back panel when the inner back panel is folded adjacent to the outer back panel.

In another aspect, a method for assembling a multi-layered blister package is provided. The method includes providing a blister sheet having a plurality of blisters for containing a product therein and an opposing cover surface. Each blister includes an opening adjacent to the cover surface. The method also includes providing a front sheet having a plurality of apertures and receiving the plurality of blisters on the blister sheet in the apertures. Further, the method includes coupling a back sheet to at least a portion of the front sheet. The back sheet including an inner back panel foldably connected to an outer back panel. Further, the method includes providing each of the inner and outer back panels with a plurality of removable tabs each covering an access slot, folding the inner back panel adjacent to the outer back panel to align the tabs and access slots of the inner back panel with the tabs and access slots of the outer back panel, and positioning the cover surface of the blister sheet adjacent to the inner back panel such that each blister opening is in alignment with the tabs and access slots of the inner back panel and the tabs and access slots of the outer back panel.

DETAILED DESCRIPTION OF THE INVENTION

The exemplary systems and methods described herein overcome the structural disadvantages of known blister packages by facilitating a balancing of child-resistant, senior friendly and tamperproof features.

Various exemplary details are described herein, with reference to the FIGS. 1-4, wherein like numerals refer to like parts.

It should be appreciated that "horizontal" and "horizontally" is used throughout this application to refer to directions and orientations extending from the left to the right of the page, and vice versa, for the ease of understanding.

It should be appreciated that "vertical" and "vertically" is used throughout the application to refer to directions and orientations extending from the bottom to the top of the page, and vice versa, for the ease of understanding. It should also be appreciated that "vertical" and "vertically" is used to reference directions and orientations substantially perpendicular to the "horizontal" and "horizontally" disposed features.

Figure 1:
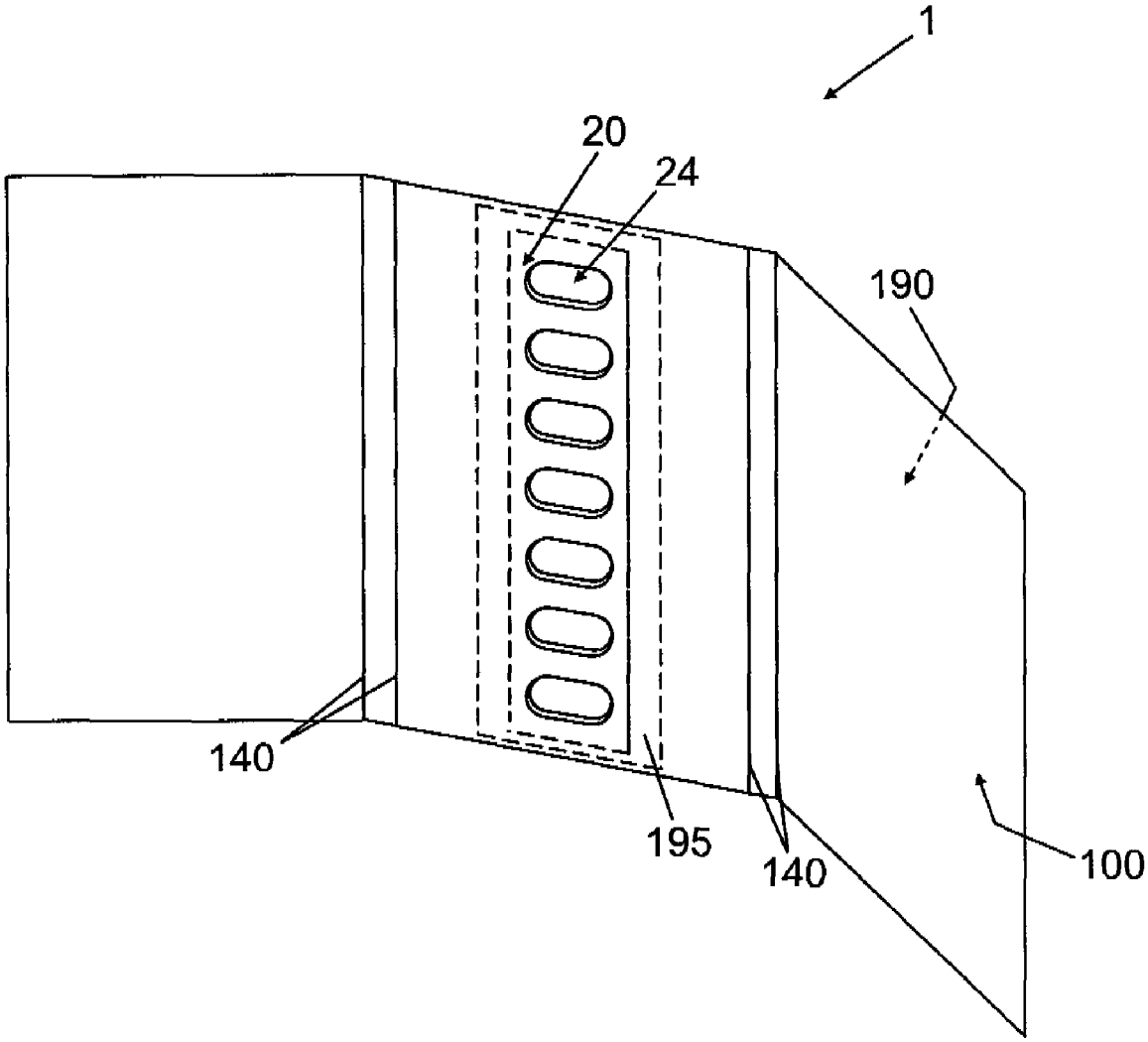
FIG. 1 is a perspective view of an exemplary embodiment of a multi-layered blister package in a partially opened position.

FIG. 1 illustrates a perspective view of an exemplary multi-layered blister package 1 in a partially opened position. As shown in FIG. 1, the blister package 1 includes at least the following layers: a blister sheet 20, a front sheet 100, and a back sheet 190 having a flap 195. Each layer of the blister package 1 is described in greater detail hereinafter.

The blister sheet 20 may be fabricated from a substantially transparent plastic material. The blister sheet 20 includes a plurality of protruding blisters 24 including a closed end and an opened end (not shown). The blisters 24 are linearly aligned in a vertical column. Each blister 24 is a receptacle such as, but not limited to, a cup and a pocket that may receive a product therein. The opened end of the blister 24 may be sealed off by a reinforcing layer such as, but not limited to, a foil layer (not shown). As a result, the product may be retained and subsequently dispensed from the blister package 1 by depressing the respective blister 24 of the blister sheet 20 so that the product may puncture through the foil layer. In a fully assembled position of the blister package 1, the blister sheet 20 is positioned between the front sheet 100 and the back sheet 190.

In one exemplary embodiment, the blister sheet 20 is fabricated from a substantially transparent depressible plastic material. However, it should be appreciated that the blister sheet 20 may also be fabricated from any suitable material known to those skilled in the art and guided by the provided teachings, and therefore is not limited to a specific type of material.

Figure 2:
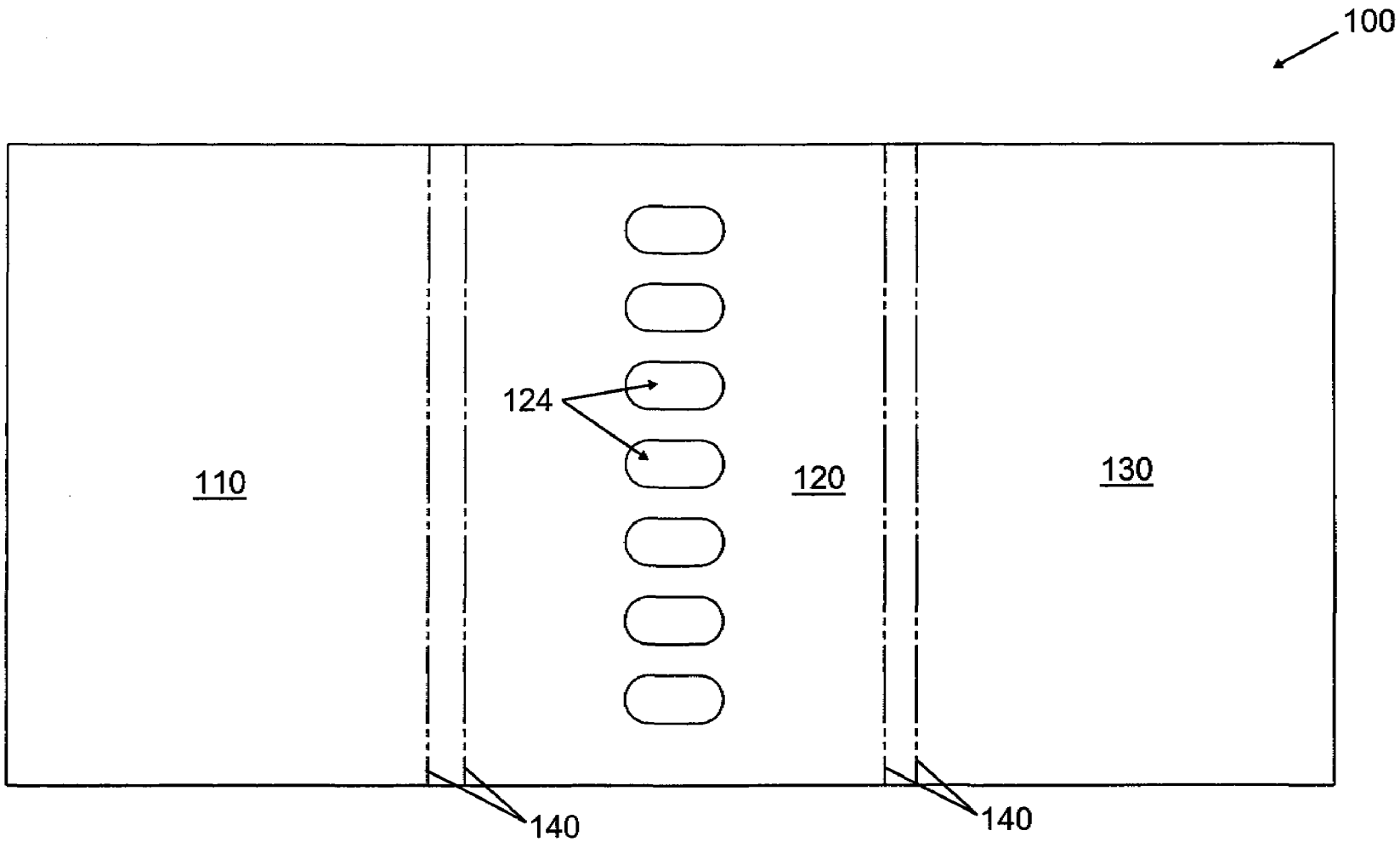
FIG. 2 is a plan view of an exemplary embodiment of a front sheet of the exemplary multi-layered blister package shown in FIG. 1.

FIG. 2 illustrates a plan view of an exemplary front sheet 100 of blister package 1 (shown in FIG. 1). As shown in FIG. 2, the front sheet 100 may be fabricated from a substantially planar blank of a substantially paperboard material. The front sheet 100 may include a plurality of panels connected to each other and aligned in a horizontal direction with a plurality of fold lines dividing the panels.

The panels include a first panel 110, a central second panel 120, and a third panel 130. Each of the panels 110, 120, 130 of the front sheet 100 is separated from another panel by at least one substantially vertical fold line 140. The first and third panels 110, 130 are positioned adjacent to opposing end portions of the second panel 120.

The second panel 120 includes a plurality of spaced apertures 124 that are linearly aligned in a vertical column. Each aperture 124 is sized to receive a respective blister 24. Providing the blister receiving apertures 124 in the central second panel 120 is preferable because such panel is centrally positioned to help facilitate protecting the blisters 24 from being tampered with and/or accidentally depressed. Also, the central placement of the blisters 24 helps to restrict children from accessing the product contained therein as compared to edge placed blisters that may be more easily accessed by children.

Although the second panel 120 is described as including the blister receiving apertures 124, it should be appreciated that a plurality of blister receiving apertures may alternatively or additionally be provided in the first and/or the third panels 110, 130.

In one exemplary embodiment, the front sheet of the blister package is fabricated from a substantially paperboard material. However, it should be appreciated that the front sheet may be fabricated from any suitable material such as, but not limited to cardboard, corrugated board, plastic and/or any suitable material known to those skilled in the art and guided by the provided teachings. Therefore, the front sheet is not limited to a specific type of material provided that the material facilitates folding along the fold lines where such folding has been described.

Figure 3:
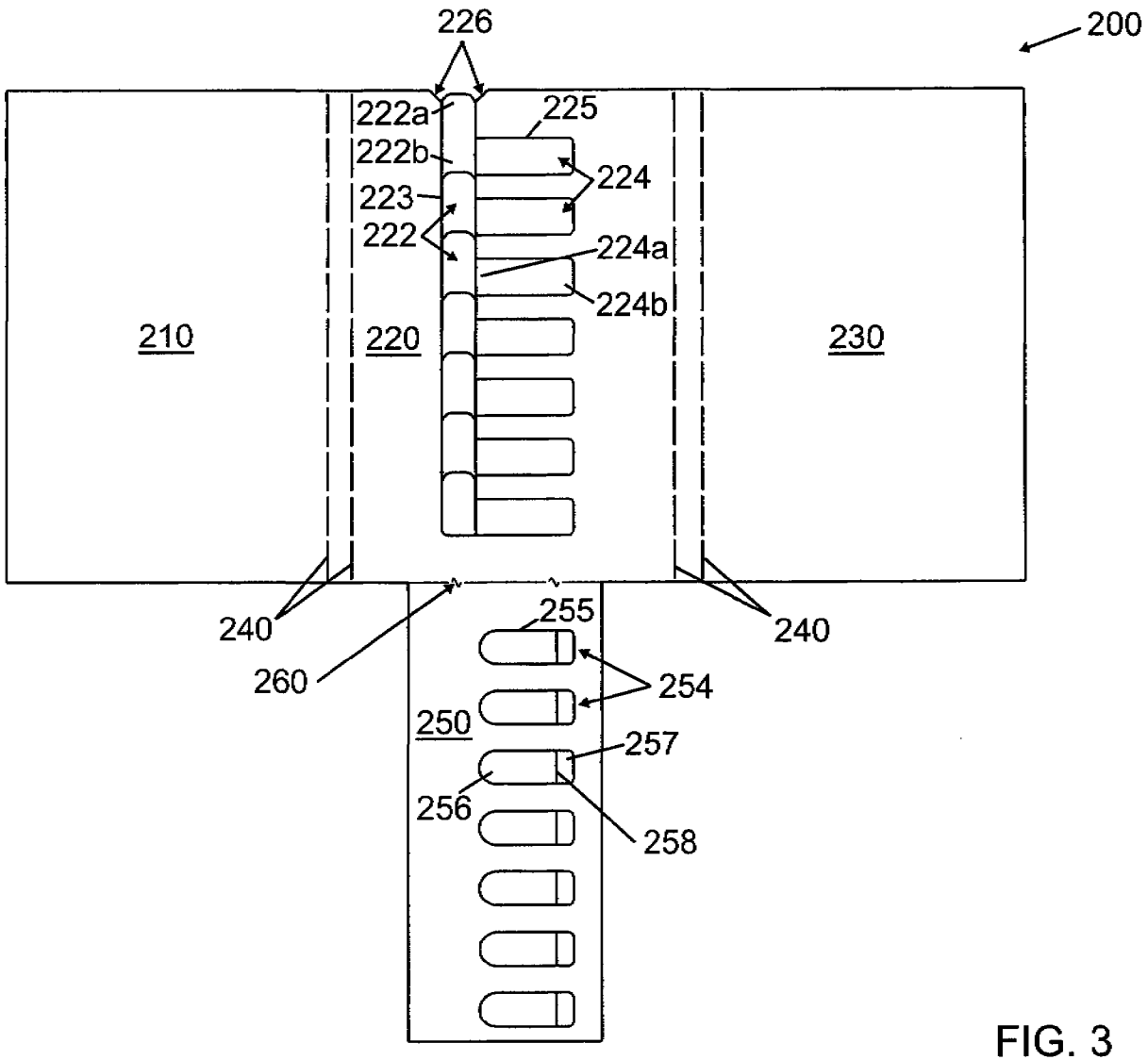
FIG. 3 is a plan view of a first exemplary embodiment of a back sheet of the exemplary multi-layered blister package shown in FIG. 1.

FIG. 3 illustrates a plan view of a first embodiment of a back sheet 200 of blister package 1 (shown in FIG. 1). As shown in FIG. 3, the back sheet 200 may be fabricated from a substantially planar blank made substantially of paperboard material. The back sheet 200 may include a plurality of panels connected to one another and a plurality of fold lines dividing the panels.

The back sheet 200 includes a plurality of panels 210, 220, 230 linearly aligned in a horizontal direction and a vertically extending flap 250. The panels include a first panel 210, a central second panel 220, and a third panel 230. Each of the panels 210, 220, 230 of the back sheet 200 is separated from another panel by at least one substantially vertical fold line 240. The first and third panels 210, 230 are positioned adjacent to opposing end portions of the second panel 220.

The second panel 220 includes a plurality of connecting tabs 222, a plurality of spaced tabs 224, and a plurality of notches 226. The connecting tabs 222 are linearly aligned in a first vertical column. The spaced tabs 224 are linearly aligned in an adjacent second vertical column.

Each connecting tab 222 is a perforated tear away area that is defined by a respective partially surrounding perforation 223. Each connecting tab 222 includes a protruding top end 222*a* and a recessed bottom end 222*b*. The connecting tabs 222 are disposed so that the top end 222*a* of one connecting tab 222 may be removably coupled to the bottom end 222*b* of an adjacent connecting tab 222. Therefore, adjacent connecting tabs 222 contact and border each other at coinciding perforations 223. As a result, each of the connecting tabs 222 form a linearly aligned first vertical column of the continuously disposed connecting tabs in which each connecting tab 222 may be individually removed.

The top end 222*a* of a topmost connecting tab 222 is not removably coupled to another connecting tab 222. Instead, a plurality of notches 226 is provided adjacent to such top end 222*a* to facilitate individual removal of the topmost tab 222 from the back sheet 200. The bottom end 222*b* of each tab 222 is removably coupled to an adjacent spaced tab 224 that is located in the second vertical column.

Each spaced tab 224 is a perforated tear away area that is defined by a respective surrounding perforation 225. Each spaced tabs 224 is substantially a same size as the blister respective receiving aperture 124. Each spaced tab 224 includes a side end 224*a* and an opposing side end 224*b*. The spaced tabs 224 are disposed so that the side end 224*a* of each respective spaced tab 224 is removably coupled to the bottom end 222*b* of an adjacent tab 222. Therefore, the side end 224*a* of a single spaced tab 224 contacts and borders the bottom end 222*b* of a single adjacent tab 222 at coinciding perforations 223, 225.

A single spaced tab 224 and a single adjacent tab 222 contact each other to form a horizontally aligned row of tabs. However, each of the spaced tabs 224 are spaced from or do not contact an adjacent spaced tab 224. Although the spaced tabs 224 are not connected with respect to each other, the spaced tabs 224 are aligned and register with a plurality of spaced tabs provided on the vertically extending flap 250.

The vertically extending flap 250 vertically extends and is separated from the second panel 220 by a horizontal fold line 260. The vertically extending flap 250 includes a plurality of spaced reinforcing tabs 254 that are vertically aligned and register with the spaced tabs 224 provided on the second panel 220.

Each reinforcing tab 254 is a perforated tear away area that is defined by a respective surrounding perforation 255. Each reinforcing tab 254 includes a body 256 and an engagement portion 257 that each borders a tab fold line 258. The reinforcing tabs 254 are substantially a same size as the spaced tabs 224. Therefore, the reinforcing tabs 254 provide an additional tear away tab sandwiched between the back sheet 200 and the blister sheet 20 with the foil layer.

As a result, the vertically extending flap 250 may facilitate mounting and alignment of the blister sheet 20 and the foil layer during assembly. Additionally, the reinforcing tabs 254 provide additional product dispensing barriers that are child-resistant, senior friendly, and tamperproof. Further, the vertically extending flap 250 and the reinforcing tabs 254 facilitate prevention of an accidental depression of the blisters 24 causing accidental dispensing of a product contained therein.

In one exemplary embodiment, the back sheet of the blister package is fabricated from a substantially paperboard material. However, it should be appreciated that the back sheet may be fabricated from any suitable material such as, but not limited to cardboard, corrugated board, plastic and/or any suitable material known to those skilled in the art and guided by the provided teachings. Therefore, the back sheet is not limited to a specific type of material provided that the material facilitates folding along the fold lines where such folding has been described.

Figure 4:
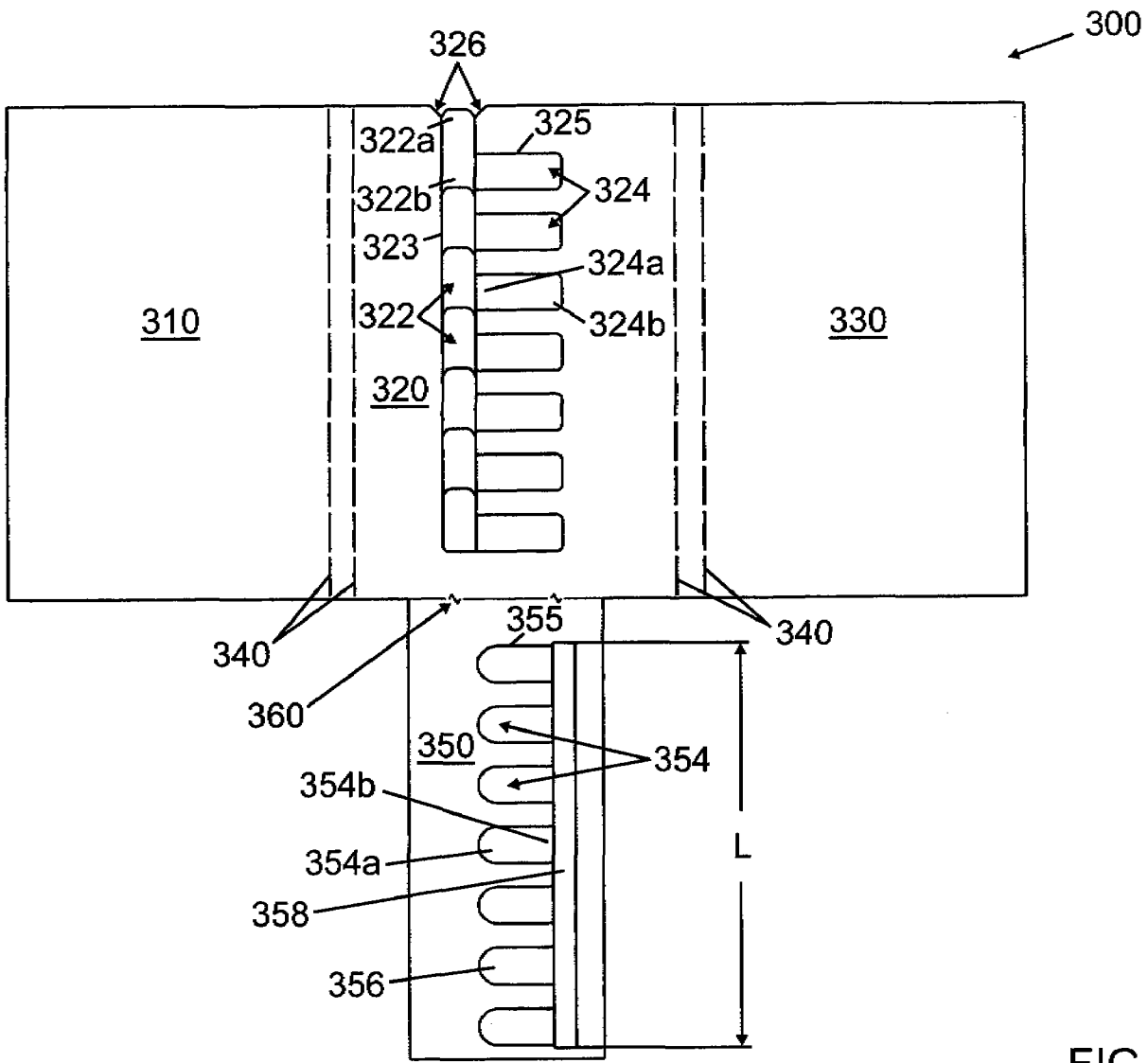
FIG. 4 is a plan view of an alternative exemplary embodiment of a back sheet of the exemplary multi-layered blister package shown in FIG. 1.

FIG. 4 illustrates a plan view of an alternative embodiment of a back sheet 300 of blister package 1 (shown in FIG. 1). As shown in FIG. 4, the back sheet 300 may be fabricated from a substantially planar blank made substantially of paperboard material. The back sheet 300 may include a plurality of panels connected to one another and a plurality of fold lines dividing the panels The back sheet 300 includes a plurality of panels 310, 320, 330 linearly aligned in a horizontal direction and a vertically extending flap 350. The panels include a first panel 310, a central second panel 320, and a third panel 330. Each of the panels 310, 320, 330 of the back sheet 300 is separated from another panel by at least one substantially vertical fold line 340. The first and third panels 310, 330 are positioned adjacent to opposing end portions of the second panel 320.

The second panel 320 includes a plurality of connecting tabs 322, a plurality of spaced tabs 324, and a plurality of notches 326. The connecting tabs 322 are linearly aligned in a first vertical column. The spaced tabs 324 are linearly aligned in an adjacent second vertical column.

Each connecting tab 322 is a perforated tear away area that is defined by a respective surrounding perforation 323. Each connecting tab 322 includes a protruding top end 322*a* and a recessed bottom end 322*b*. The connecting tabs 322 are disposed so that the top end 322*a* of one connecting tab 322 may be removably coupled to the bottom end 322*b* of an adjacent tab 322. Therefore, adjacent tabs 322 contact and border each other at coinciding perforations 323. As a result, each of the connecting tabs 322 forms a linearly aligned first vertical column of the continuously disposed connecting tabs in which each connecting tab 322 may be individually removed.

The top end 322*a* of a topmost tab 322 is not removably coupled to another tab 322. Instead, a plurality of notches 326 is provided adjacent to such top end 322*a* to facilitate individual removal of the topmost tab 322 from the back sheet 300. The bottom ends 322*b* of each tab 322 is removably coupled to an adjacent spaced tab 324 that is located in the second vertical column.

Each spaced tab 324 is a perforated tear away area that is defined by a respective surrounding perforation 325. Each spaced tabs 324 is substantially a same size as the respective blister receiving aperture 124. Each spaced tab 324 includes a side end 324*a* and an opposing side end 324*b*. The spaced tabs 324 are also disposed so that the side end 324*a* of each respective spaced tab 324 is removably coupled to the bottom end 322*b* of an adjacent tab 322. Therefore, the side end 324*a* of a single spaced tab 324 contacts and borders the bottom end 322*b* of a single adjacent tab 322 at coinciding perforations 323, 325.

A single spaced tab 324 and a single adjacent tab 322 contact each other to form a horizontally aligned row of tabs. However, each of the spaced tabs 324 are spaced from or do not contact an adjacent spaced tab 324. Although the spaced tabs 324 are not connected with respect to each other, the spaced tabs 324 are aligned and register with a plurality of spaced tabs provided on the vertically extending flap 350.

The vertically extending flap 350 vertically extends and is separated from the second panel 320 by a horizontal fold line 360. The vertically extending flap 350 includes a plurality of spaced reinforcing tabs 354 that are vertically aligned and register with the spaced tabs 324 provided on the second panel 320. Each reinforcing tab 354 is a perforated tear away area that is defined by a respective bordering perforation 355.

Similar to the exemplary embodiment shown in FIG. 3, each reinforcing tab 354 includes a body 356 having opposing side edge 354*a*, 354*b*. However, instead of a grip edge, each reinforcing tab 354 is also defined by a continuous elongated access aperture 358 having a length L that spans the side edges 354*b* of all reinforcing tabs 354. Therefore, the reinforcing tabs 354 provide an additional tear away tab sandwiched between the back sheet 300 and the blister sheet 20 with the foil layer.

As a result, the vertically extending flap 350 may facilitate mounting and alignment of the blister sheet 20 and the foil layer during assembly. Additionally, the reinforcing tabs 354 provide additional product dispensing barriers that are child-resistant, senior friendly, and tamperproof. an additional tear away tab sandwiched between the back sheet 300 and the blister sheet 20 with the foil layer. Further, the vertically extending flap 350 and the reinforcing tabs 354 facilitate prevention of an accidental depression of the blisters 24 causing accidental dispensing of a product contained therein.

In one exemplary embodiment, the back sheet of the blister package is fabricated from a substantially paperboard material. However, it should be appreciated that the back sheet may be fabricated from any suitable material such as, but not limited to cardboard, corrugated board, plastic and/or any suitable material known to those skilled in the art and guided by the provided teachings. Therefore, the back sheet is not limited to a specific type of material provided that the material facilitates folding along the fold lines where such folding has been described.

An exemplary method of assembling the blister package and an exemplary method of removing a product from an assembled blister package are described below.

To assemble the blister package 1, the spaced blisters 24 of the blister sheet 20 may be aligned with and positioned in the apertures 124 that are provided in the second panel 120 of the front sheet 100. The blister sheet 20 may be fixed to the second panel 120 in such an aligned position. Prior to or after the blisters 24 are positioned in the respective apertures 124, products may be placed in the blisters 24. Subsequently, the foil layer may be fixed to the blister sheet 20 to cover the opened ends of the blisters 24 to seal the products within the blisters 24. The front sheet 100 and the blister sheet 20 may then be fixed to the back sheet 200, 300.

Prior to fixing the back sheet 200, 300, the vertically extending flap 250, 350 is folded about a horizontal fold line 260, 360 onto the second panel 220, 320 of the back sheet 200, 300. As a result, the spaced reinforcing tabs 254, 354 of the vertically extending flap 250, 350 are aligned and registered with the spaced tabs 224, 324 of the second panel 220, 320 of the back sheet 200, 300. In this folded flap position, the back sheet 200, 300 is fixed to the blister sheet 20 and the front sheet 100 so that the reinforcing tabs 254, 354 and the spaced tabs 224, 324 register with the respective aperture 124 of the second panel 220, 320 of the front sheet 100. The first and third panels 110, 130 may then be folded onto the second panel 120 along the vertical fold line 140 in a fully folded position to protect the centrally located second panel 120.

To remove a product from the blister package 1, respective tabs are removed to facilitate access to a cavity of the blister 24. For example, the protruding top end 222*a*, 322*a* of the topmost tab 222, 322 may be engaged by accessing the notches 226, 326 to tear away the topmost tab 222, 322 along the perforations 223, 323. After the topmost tab 222, 322 is removed, an access slot is provided to facilitate access to the respective adjacent spaced tab 224, 324. The side end portion 224*a*, 324*a* of the spaced tab 224, 324 may then be engaged by accessing the opening to tear away the spaced tab 224, 324. After the adjacent spaced tab 224, 324 is removed, a second access slot is provided to facilitate access to the respective registered/aligned reinforcing tab 254, 354.

If the reinforcing tab 254 includes the body 256 and the engagement portion 257, then the engagement portion 257 of the reinforcing tab 254 may be engaged by accessing the second opening to tear away the reinforcing tab 254 along the perforations 255. If the reinforcing tab 354 is adjacent to the connecting elongated access aperture 358, then the side edge 354*b* of the body 356 of the reinforcing tab 354 may be engaged by accessing the second opening to tear away the reinforcing tab 354 along the perforations 355.

Once the respective tabs are removed, the closed ends of the blisters 24 are depressed. As a result of removal of the tabs and a pressing force, the product may puncture through the foil layer to release the product from the blister package 1.

Although the blisters 24 described above have not been specifically described, it should be appreciated that any type of size, shape, and/or material such as, but limited to a small oval transparent plastic blister, may be used provided that the blister facilitates retaining and dispensing of a contained product where such retaining and dispensing has been described.

It should also be appreciated that the front sheet 100, the blister sheet 20, the underlying foil layer, the flap 250, 350, and the horizontal panels of the back sheet 200, 300 may be fixedly joined together by any suitable means such as, but limited to, an adhesive.

It should also be appreciated that the vertical and horizontal fold lines discussed above may be any weakened line such as, but not limited to, a score line and a perforated line, that may be formed by any conventional technique.

While the invention has been described in terms of various specific embodiments, those skilled in the art will recognize that the invention can be practiced with modification within the spirit and scope of the claims.

What is claimed is:

1. A multi-layered blister package, comprising:

a blister sheet having a plurality of blisters for containing a product therein and an opposing cover surface, wherein each blister includes an opening adjacent to said cover surface;

a front sheet having a plurality of apertures configured to receive said plurality of blisters on said blister sheet;

a back sheet coupled to at least a portion of said front sheet, said back sheet comprising an inner back panel foldably connected to an outer back panel, wherein said outer back panel includes a plurality of connecting tabs each respectively adjacent a spaced tab of a plurality of spaced tabs and covering an access slot, including a first connecting tab adjacent a first spaced tab, wherein said inner back panel includes a plurality of engagement portions each respectively adjacent a reinforcing tab of a plurality of reinforcing tabs, including a first engagement portion adjacent a first reinforcing tab, wherein said inner back panel is positioned to be adjacent to said outer back panel;

wherein said cover surface of said blister sheet is positioned adjacent to said inner back panel such that each blister opening is in alignment with one respective said reinforcing tab of said inner back panel and one respective said connecting tab of said outer back panel; and, wherein the first engagement portion is accessible only after removal of the first spaced tab.

2. The multi-layered blister package of claim 1 wherein said reinforcing tabs are spaced apart from one another.

3. The multi-layered blister package of claim 1 wherein each said connecting tab is individually removable.

4. The multi-layered blister package of claim 1 wherein each of said reinforcing tabs comprises a body.

5. The multi-layered blister package of claim 4 wherein each said engagement portion is separated from a respective said body by a tab fold line.

6. The multi-layered blister package of claim 1 wherein said outer back panel comprises a plurality of notches on a horizontal edge thereof to facilitate removal of said first connecting tab.

7. A multi-layered blister package, comprising:

a blister sheet having a plurality of blisters for containing a product therein and a plurality of openings corresponding to the plurality of blisters, each said opening of the plurality of openings being covered by a cover layer;

a front sheet having a plurality of apertures configured to receive the plurality of blisters;

a back sheet coupled to at least a portion of the front sheet, the back sheet including a plurality of connecting tabs each respectively adjacent a spaced tab of a plurality of spaced tabs, including a first connecting tab adjacent a first spaced tab; wherein the first spaced tab is removable only after removal of the first connecting tab;

a flap foldably connected to the back sheet; the flap including a plurality of engagement portions each respectively adjacent a reinforcing tab of a plurality of reinforcing tabs, including a first engagement portion adjacent a first reinforcing tab; wherein removal of the first engagement portion provides access to the first reinforcing tab;

wherein when the flap is folded to be adjacent the back sheet, the plurality of spaced tabs of the back sheet are in alignment with the plurality of reinforcing tabs of the flap, with the first spaced tab being in alignment with the first reinforcing tab; and, wherein the first engagement portion is accessible only after removal of the first spaced tab.

8. The package of claim 7 wherein the first spaced tab is removed in a first direction and the first reinforcing tab is removed in a second direction, the second direction being opposite the first direction.

* * * * *